US010783857B2

(12) United States Patent
Lambert et al.

(10) Patent No.: US 10,783,857 B2
(45) Date of Patent: Sep. 22, 2020

(54) APPARATUS AND METHOD FOR FAST MEMORY VALIDATION IN A BASEBOARD MANAGEMENT CONTROLLER

(71) Applicant: DELL PRODUCTS, LP, Round Rock, TX (US)

(72) Inventors: Timothy M. Lambert, Austin, TX (US); Pablo R. Arias, Austin, TX (US); Eugene D. Cho, Austin, TX (US)

(73) Assignee: DELL PRODUCTS, LP, Round Rock, TX (US)

( * ) Notice: Subject to any disclaimer, the term of this patent is extended or adjusted under 35 U.S.C. 154(b) by 70 days.

(21) Appl. No.: 16/053,436

(22) Filed: Aug. 2, 2018

(65) Prior Publication Data

US 2020/0043444 A1 Feb. 6, 2020

(51) Int. Cl.
*G09G 5/39* (2006.01)

(52) U.S. Cl.
CPC ..... *G09G 5/39* (2013.01); *G09G 2320/103* (2013.01); *G09G 2360/18* (2013.01)

(58) Field of Classification Search
CPC . G09G 5/39; G09G 2360/18; G09G 2320/103
See application file for complete search history.

(56) References Cited

U.S. PATENT DOCUMENTS 6,701,420 B1 * 3/2004 Hamilton ..... G06F 12/023 707/999.202
8,910,020 B2 12/2014 Frayer et al.
9,627,085 B2 4/2017 Yang
9,898,196 B1 * 2/2018 Karamcheti ..... G06F 12/121
2002/0116555 A1 * 8/2002 Somers ..... G06F 13/28 710/26
2010/0064097 A1 3/2010 Iwamura et al.
2010/0223432 A1 * 9/2010 Eidus ..... G06F 12/109 711/148
2011/0255690 A1 * 10/2011 Kocher ..... H04N 21/42646 380/210
2012/0017028 A1 * 1/2012 Tsirkin ..... G06F 12/08 711/6
2016/0275037 A1 * 9/2016 Dube ..... H04L 65/602
2017/0162271 A1 6/2017 Yang

* cited by examiner

*Primary Examiner* — Barry Drennan
*Assistant Examiner* — Khoa Vu
(74) *Attorney, Agent, or Firm* — Larson Newman, LLP; Timothy G. Newman

(57) ABSTRACT

An information handling system includes a host processing complex with a memory, and a baseboard management controller (BMC) with a processor and a video capture and difference engine (VCDE). The processor receives a memory compare command. The memory compare command includes a first pointer to a first block of the memory, a second pointer to a second block of the memory, and a memory block size. The processor further determines whether the memory block size is greater than a threshold, and forwards the memory compare command to the VCDE when the memory block size is greater than the threshold. The VCDE compares contents of the first block to contents of the second block in response to receiving the memory compare command.

20 Claims, 3 Drawing Sheets

APPARATUS AND METHOD FOR FAST MEMORY VALIDATION IN A BASEBOARD MANAGEMENT CONTROLLER

FIELD OF THE DISCLOSURE

This disclosure generally relates to information handling systems, and more particularly relates to performing memory validation in a baseboard management controller.

BACKGROUND

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements may vary between different applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, reservations, enterprise data storage, or global communications. In addition, information handling systems may include a variety of hardware and software resources that may be configured to process, store, and communicate information and may include one or more computer systems, data storage systems, and networking systems.

SUMMARY

An information handling system may include a host processing complex with a memory, and a baseboard management controller (BMC) with a processor and a video capture and difference engine (VCDE). The processor may receive a memory compare command. The memory compare command may include a first pointer to a first block of the memory, a second pointer to a second block of the memory, and a memory block size. The processor may further determine whether the memory block size is greater than a threshold and forward the memory compare command to the VCDE when the memory block size is greater than the threshold. The VCDE may compare contents of the first block to contents of the second block in response to receiving the memory compare command

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

The use of the same reference symbols in different drawings indicates similar or identical items.

DETAILED DESCRIPTION OF DRAWINGS

The following description in combination with the Figures is provided to assist in understanding the teachings disclosed herein. The following discussion will focus on specific implementations and embodiments of the teachings. This focus is provided to assist in describing the teachings, and should not be interpreted as a limitation on the scope or applicability of the teachings. However, other teachings can certainly be used in this application. The teachings can also be used in other applications, and with several different types of architectures, such as distributed computing architectures, client/server architectures, or middleware server architectures and associated resources.

Figure 1:
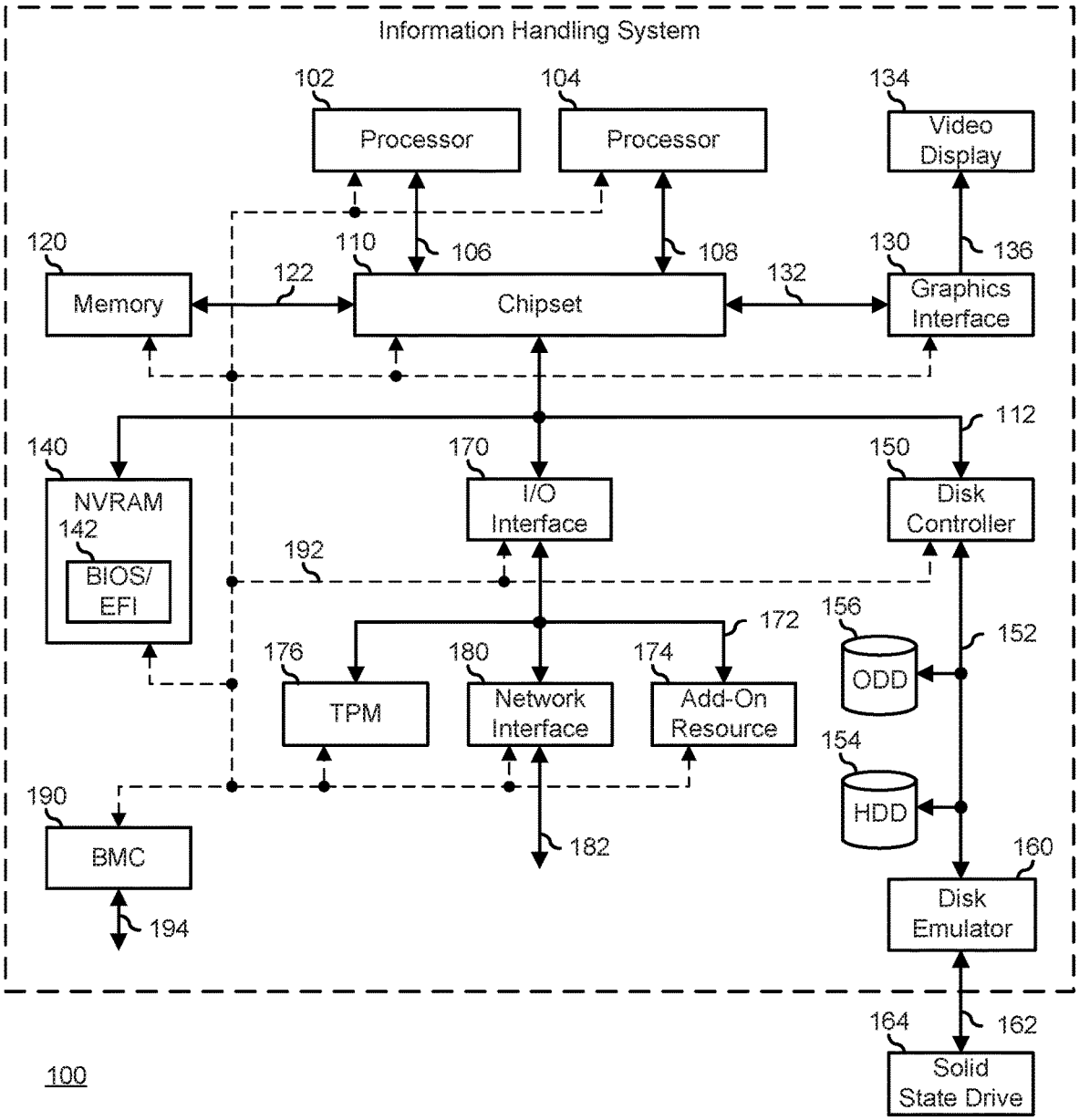
FIG. 1 is a block diagram of an information handling system according to an embodiment of the present disclosure.

FIG. 1 illustrates an embodiment of an information handling system 100 including processors 102 and 104, a chipset 110, a memory 120, a graphics adapter 130 connected to a video display 134, a non-volatile RAM (NV-RAM) 140 that includes a basic input and output system/extensible firmware interface (BIOS/EFI) module 142, a disk controller 150, a hard disk drive (HDD) 154, an optical disk drive 156, a disk emulator 160 connected to a solid state drive (SSD) 164, an input/output (I/O) interface 170 connected to an add-on resource 174 and a trusted platform module (TPM 176, a network interface 180, and a baseboard management controller (BMC) 190. Processor 102 is connected to chipset 110 via processor interface 106, and processor 104 is connected to the chipset via processor interface 108. In a particular embodiment, processors 102 and 104 are connected together via a high-capacity coherent fabric, such as a HyperTransport link, a QuickPath Interconnect, or the like.

Chipset 110 represents an integrated circuit or group of integrated circuits that manages the data flows between processors 102 and 104 and the other elements of information handling system 100. In a particular embodiment, chipset 110 represents a pair of integrated circuits, such as a northbridge component and a southbridge component. In another embodiment, some or all of the functions and features of chipset 110 are integrated with one or more of processors 102 and 104. Memory 120 is connected to chipset 110 via a memory interface 122. An example of memory interface 122 includes a Double Data Rate (DDR) memory channel and memory 120 represents one or more DDR Dual In-Line Memory Modules (DIMMs). In a particular embodiment, memory interface 122 represents two or more DDR channels. In another embodiment, one or more of processors 102 and 104 include a memory interface that provides a dedicated memory for the processors. A DDR channel and the connected DDR DIMMs can be in accordance with a particular DDR standard, such as a DDR3 standard, a DDR4 standard, a DDR5 standard, or the like. Memory 120 may further represent various combinations of memory types, such as Dynamic Random Access Memory (DRAM) DIMMs, Static Random Access Memory (SRAM) DIMMs, non-volatile DIMMs (NV-DIMMs), storage class memory devices, Read-Only Memory (ROM) devices, or the like.

Graphics adapter 130 is connected to chipset 110 via a graphics interface 132, and provides a video display output 136 to a video display 134. An example of a graphics interface 132 includes a Peripheral Component Interconnect-Express (PCIe) interface and graphics adapter 130 can include a four lane (×4) PCIe adapter, an eight lane (×8) PCIe adapter, a 16-lane (×16) PCIe adapter, or another configuration, as needed or desired. In a particular embodiment, graphics adapter 130 is provided down on a system printed circuit board (PCB). Video display output 136 can include a Digital Video Interface (DVI), a High-Definition Multimedia Interface (HDMI), a DisplayPort interface, or the like, and video display 134 can include a monitor, a smart television, an embedded display such as a laptop computer display, or the like.

NV-RAM 140, disk controller 150, and I/O interface 170 are connected to chipset 110 via an I/O channel 112. An example of I/O channel 112 includes one or more point-to-point PCIe links between chipset 110 and each of NV-RAM 140, disk controller 150, and I/O interface 170. Chipset 110 can also include one or more other I/O interfaces, including an Industry Standard Architecture (ISA) interface, a Small Computer Serial Interface (SCSI) interface, an Inter-Integrated Circuit ($I^2C$) interface, a System Packet Interface (SPI), a Universal Serial Bus (USB), another interface, or a combination thereof. NV-RAM 140 includes BIOS/EFI module 142 that stores machine-executable code (BIOS/EFI code) that operates to detect the resources of information handling system 100, to provide drivers for the resources, to initialize the resources, and to provide common access mechanisms for the resources. The functions and features of BIOS/EFI module 142 will be further described below.

Disk controller 150 includes a disk interface 152 that connects the disc controller to a hard disk drive (HDD) 154, to an optical disk drive (ODD) 156, and to disk emulator 160. An example of disk interface 152 includes an Integrated Drive Electronics (IDE) interface, an Advanced Technology Attachment (ATA) such as a parallel ATA (PATA) interface or a serial ATA (SATA) interface, a SCSI interface, a USB interface, a proprietary interface, or a combination thereof. Disk emulator 160 permits a solid-state drive (SSD) 164 to be connected to information handling system 100 via an external interface 162. An example of external interface 162 includes a USB interface, an IEEE 1394 (Firewire) interface, a proprietary interface, or a combination thereof. Alternatively, solid-state drive 164 can be disposed within information handling system 100.

I/O interface 170 includes a peripheral interface 172 that connects the I/O interface to add-on resource 174, to TPM 176, and to network interface 180. Peripheral interface 172 can be the same type of interface as I/O channel 112, or can be a different type of interface. As such, I/O interface 170 extends the capacity of I/O channel 112 when peripheral interface 172 and the I/O channel are of the same type, and the I/O interface translates information from a format suitable to the I/O channel to a format suitable to the peripheral channel 172 when they are of a different type. Add-on resource 174 can include a data storage system, an additional graphics interface, a network interface card (NIC), a sound/video processing card, another add-on resource, or a combination thereof. Add-on resource 174 can be on a main circuit board, on separate circuit board or add-in card disposed within information handling system 100, a device that is external to the information handling system, or a combination thereof.

Network interface 180 represents a network communication device disposed within information handling system 100, on a main circuit board of the information handling system, integrated onto another component such as chipset 110, in another suitable location, or a combination thereof. Network interface device 180 includes a network channel 182 that provides an interface to devices that are external to information handling system 100. In a particular embodiment, network channel 182 is of a different type than peripheral channel 172 and network interface 180 translates information from a format suitable to the peripheral channel to a format suitable to external devices. In a particular embodiment, network interface 180 includes a network interface card (NIC) or host bus adapter (HBA), and an example of network channel 182 includes an InfiniBand channel, a Fibre Channel, a Gigabit Ethernet channel, a proprietary channel architecture, or a combination thereof. In another embodiment, network interface 180 includes a wireless communication interface, and network channel 182 includes a WiFi channel, a near-field communication (NFC) channel, a Bluetooth or Bluetooth-Low-Energy (BLE) channel, a cellular based interface such as a Global System for Mobile (GSM) interface, a Code-Division Multiple Access (CDMA) interface, a Universal Mobile Telecommunications System (UMTS) interface, a Long-Term Evolution (LTE) interface, or another cellular based interface, or a combination thereof. Network channel 182 can be connected to an external network resource (not illustrated). The network resource can include another information handling system, a data storage system, another network, a grid management system, another suitable resource, or a combination thereof.

BMC 190 is connected to multiple elements of information handling system 100 via one or more management interface 192 to provide out of band monitoring, maintenance, and control of the elements of the information handling system. As such, BMC 190 represents a processing device different from processor 102 and processor 104, which provides various management functions for information handling system 100. For example, BMC 190 may be responsible for power management, cooling management, and the like. The term baseboard management controller (BMC) is often used in the context of server systems, while in a consumer-level device a BMC may be referred to as an embedded controller (EC). A BMC included at a data storage system can be referred to as a storage enclosure processor. A BMC included at a chassis of a blade server can be referred to as a chassis management controller and embedded controllers included at the blades of the blade server can be referred to as blade management controllers. Capabilities and functions provided by BMC 180 can vary considerably based on the type of information handling system. BMC 190 can operate in accordance with an Intelligent Platform Management Interface (IPMI). Examples of BMC 190 include an Integrated Dell Remote Access Controller (iDRAC). Management interface 192 represents one or more out-of-band communication interfaces between BMC 190 and the elements of information handling system 100, and can include an Inter-Integrated Circuit (I2C) bus, a System Management Bus (SMBUS), a Power Management Bus (PMBUS), a Low Pin Count (LPC) interface, a serial bus such as a Universal Serial Bus (USB) or a Serial Peripheral Interface (SPI), a network interface such as an Ethernet interface, a high-speed serial data link such as a Peripheral Component Interconnect-Express (PCIe) interface, a Network Controller Sideband Interface (NC-SI), or the like. As used herein, out-of-band access refers to operations performed apart from a BIOS/operating system execution environment on information handling system 100, that is apart from the execution of code by processors 102 and 104 and procedures that are implemented on the information handling system in response to the executed code.

BMC 190 operates to monitor and maintain system firmware, such as code stored in BIOS/EFI module 142, option ROMs for graphics interface 130, disk controller 150, add-on resource 174, network interface 180, or other elements of information handling system 100, as needed or desired. In particular, BMC 190 includes a network interface 194 that can be connected to a remote management system to receive firmware updates, as needed or desired. Here, BMC 190 receives the firmware updates, stores the updates to a data storage device associated with the BMC, transfers the firmware updates to NV-RAM of the device or system that is the subject of the firmware update, thereby replacing the currently operating firmware associated with the device or system, and reboots information handling system, whereupon the device or system utilizes the updated firmware image. BMC 190 utilizes various protocols and application programming interfaces (APIs) to direct and control the processes for monitoring and maintaining the system firmware. An example of a protocol or API for monitoring and maintaining the system firmware includes a graphical user interface (GUI) GUI associated with BMC 190, an interface defined by the Distributed Management Taskforce (DMTF) (e.g., a Web Services Management (WS-MAN) interface, a Management Component Transport Protocol (MCTP) or, a Redfish interface), various vendor defined interfaces (e.g., a Dell EMC Remote Access Controller Administrator (RACADM) utility, a Dell EMC OpenManage Server Administrator (OMSS) utility, a Dell EMC OpenManage Storage Services (OMSS) utility, or a Dell EMC OpenManage Deployment Toolkit (DTK) suite), a BIOS setup utility such as invoked by a "F2" boot option, or another protocol or API, as needed or desired.

In a particular embodiment, BMC 190 is included on a main circuit board (e.g., a baseboard, a motherboard, or any combination thereof) of information handling system 100, or is integrated onto another element of the information handling system such as chipset 110, or another suitable element, as needed or desired. As such, BMC 190 can be part of an integrated circuit or a chip set within information handling system 100. An example of BMC 190 includes an integrated Dell remote access controller (iDRAC), or the like. BMC 190 may operate on a separate power plane from other resources in information handling system 100. Thus BMC 190 can communicate with the management system via network interface 194 while the resources of information handling system 100 are powered off. Here, information can be sent from the management system to BMC 190 and the information can be stored in a RAM or NV-RAM associated with the BMC. Information stored in the RAM may be lost after power-down of the power plane for BMC 190, while information stored in the NV-RAM may be saved through a power-down/power-up cycle of the power plane for the BMC.

In a typical usage case, information handling system 100 provides secure access to various resources of the information handling system or of other network-based resources that are connected to the information handling system via one or more interface of network interface 180. For example, information handling system 100 may employ a hierarchical authentication and access scheme that permits a user of the information handling system to have different levels of access to the secure resources based upon various authentication credentials that are provided by the user. Further, the individual secure resources, and particularly web-based resources, may each employ their own authentication and access schemes based upon authentication credentials that are provided by the user for access to the various secure resources. As such a user may be required to provide login credentials to access the OS of information handling system 100, and to provide different login credentials to access each of a virtual private network (VPN), an authenticated web-based service such as Facebook or Google, a payment or banking network, or the like. Thus, in the course of a session using information handling system 100, the user may be required to provide a myriad of login credentials at various times in the session, based upon the usage to which the user puts the information handling system.

Figure 2:
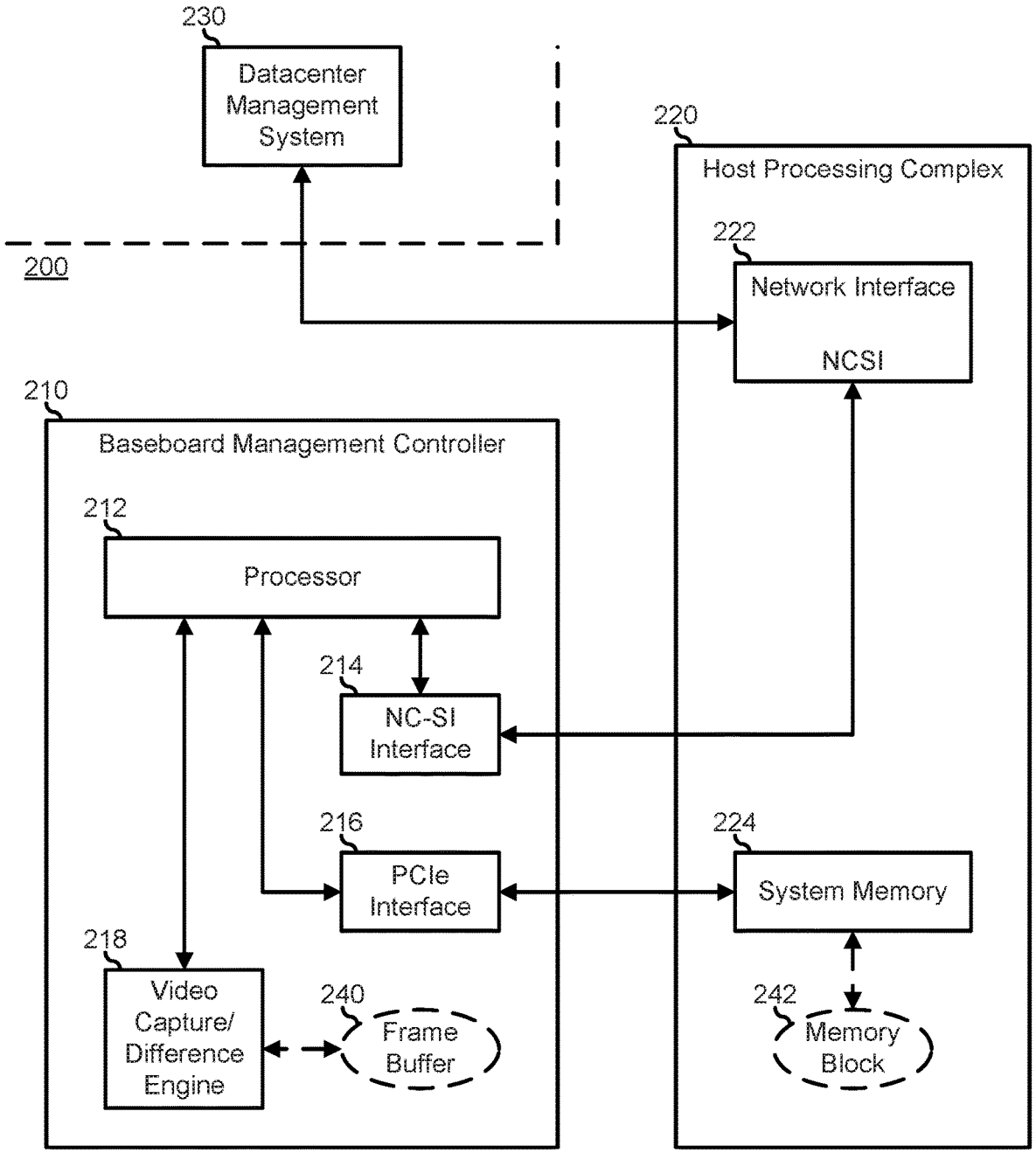
FIG. 2 is a block diagram of an information handling system according to another embodiment of the present disclosure.

FIG. 2 illustrates an information handling system 200, similar to information handlings system 100, and a datacenter management system 230. Information handling system 200 includes a BMC 210 and a host processing system 220. BMC 210 includes a processor 212, a Network Controller Sideband Interface (NCSI) 214, a PCIe interface 216, and a video capture and difference engine (VCDE) 218. Host processing system 220 includes a network interface device 222 and a system memory 224. BMC 210 operates to monitor and maintain the elements of host processing system 220. As such, BMC 210 is similar to BMC 190, and host processing complex 220 is similar to the other elements of information handling system 100. In particular, network interface device 212 is similar to network interface 180, and system memory 224 is representative of one or more of memory 120, NV-RAM 140, a storage device on disk controller 150, or another memory of information handlings system 100.

BMC 210 provides an interface through which datacenter management system 230 interacts with information handling system 200. In particular, BMC 210 operates to emulate a human interface device (HID), that is, a keyboard/mouse interface, on host processing complex 220 and to provide a basic video interface for the host processing complex. In this embodiment, a HID driver on host processing complex 220 provides HID inputs to BMC 210, and processor 212 forwards the HID inputs to NC-SI interface 214 which communicates the HID inputs to datacenter management system 230 via network interface device 222. Similarly, host processing complex 220 provides a video driver that provides video input to a video frame buffer 240 of BMC 210. VCDE 218 operates to provide the contents of video frame buffer 240 to processor 212 which forwards the video content to datacenter management system 230 via NC-SI interface 214 and network interface 222. VCDE 218 further operates to compress the video information stream to datacenter management system 230 by comparing successive video frames from host processing complex 220 to each other to identify the differences between the video frames. Then, the video information transmitted to data center management system 230 can consist of an abbreviated stream of information that captures the difference information. For example, the video frames may consist of a display of a BIOS set-up screen. Then when no changes are made to the BIOS set-up options, then VCDE 218 can detect no changes in successive video frames. Here, VCDE 218 can provide video information to datacenter management system 230 that merely informs the datacenter management system that there was no change in the video information. On the other hand, when a BIOS set-up option is changed, only a few pixels of the video frame information is changed. Here, VCDE 218 can quickly compare the successive video frames and identify the changes, and the VCDE can again provide just enough information to datacenter management controller 230 to communicate the changes to the video frames. In either case, such video information utilizes less bandwidth on network interface device 222 than would full video frame information.

BMC 210 further operates to compare the contents of various blocks 242 of system memory 224 to determine if the blocks contain the same information. In particular, processor 212 implements a block memory compare command, such as a memcmp, which takes as arguments, a beginning location of a first memory block, a beginning location of a second memory block, and a block size. The memory blocks are represented generically as memory block 242. In response to the block memory compare command, processor 212 successively reads the contents of the memory blocks, compares the contents, and indicates when there is a difference in the content of the memory blocks. For example, in the process of updating or modifying firmware code for host processing complex 220, or while checking whether or not firmware code has been tampered with, it may be advantageous to perform a block memory compare command on the existing firmware image versus an updated firmware image, or a known good firmware image. The execution of a block memory compare command by processor 212 directly utilizes the processing resources of the processor to read the contents from the memory blocks, to perform the comparison operations, and to indicate when there are differences in the contents of the memory blocks. The amount of processing resources is related to the size of the memory blocks that are being compared.

In a particular embodiment, when BMC 210 is utilized to perform a block memory compare operation, the BMC utilizes the difference function of VCDE 218 to make the comparison of the blocks of memory. In particular, BMC 210 determines whether or not the block size of a block memory compare operation is greater than a particular threshold. If not, the block memory compare operation is performed by processor 212 as described above. On the other hand, if the block memory compare operation involves block size that is greater than the threshold, then the block memory compare operation is provided to VCDE 218 as a call to compare two memory blocks in system memory 224. Here, in a memory-to-memory mode, VCDE 218 utilizes its comparison logic to compare the contents of different locations of memory block 242. In contrast, in the comparison operation as described above, VCDE 218 operates in a buffer-to-memory mode to compare the contents of video memory buffer 240 with the contents of memory block 242. An example of a block size threshold includes 512 bytes, or another number of bytes, as needed or desired.

Figure 3:
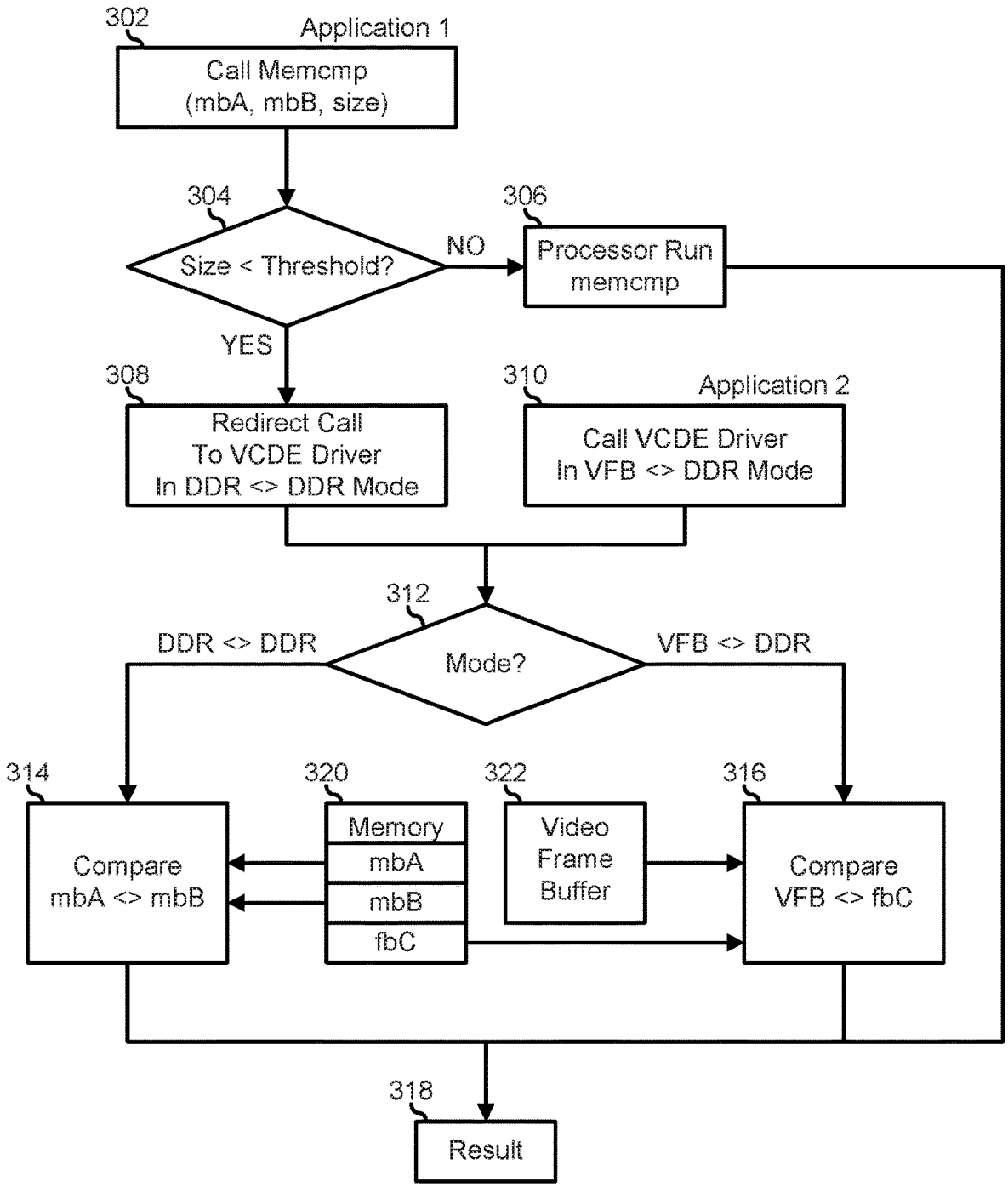
FIG. 3 is a flowchart of a method for performing memory validation in a baseboard management controller according to an embodiment of the present disclosure.

FIG. 3 illustrates a method for performing memory validation in a baseboard management controller. In block 302, a first application calls a block memory compare operation on two memory blocks of a particular size (memcmp(mbA, mbB, size)). A decision is made as to whether or not the size of the memory blocks is less than the memory block size threshold in decision block 304. If not, the "NO" branch of decision block 304 is taken, a processor of a BMC performs the block memory compare operation on the two memory blocks in block 306, and a result of the block memory compare operation is provided in block 318.

If the size of the memory blocks in the block memory compare operation is less than the memory block size threshold, the "YES" branch of decision block 304 is taken, the call to the block memory compare operation is redirected to a VCDE driver of the BMC in block 308, and the method proceeds to decision block 312 as described below. Here, the VCDE driver is called in a memory-to-memory mode. In contrast, a second application provides a call to the VCDE driver to perform a video frame compare operation in a frame-to-frame mode in block 310 and the method proceeds to decision block 312 as described below.

When the VCDE driver receives a call from either block 308 or block 310 as described above, a decision is made as to which mode is called in decision block 312. If the memory-to-memory mode is called, the "DDR<>DDR" branch of decision block 312 is taken, the VCDE compares the contents of a first block (mbA) in memory 320 with the contents of a second block (mbB) in the memory in block 314, and a result of the block memory compare operation is provided in block 318. If the frame-to-frame mode is called, the "VFB<>DDR" branch of decision block 312 is taken, the VCDE compares the contents of a video frame buffer 322 of the BMC with the contents of a third block (fbC) in memory 320 in block 316, and a result of the block memory compare operation is provided in block 318.

For purpose of this disclosure, an information handling system can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system can be a personal computer, a laptop computer, a smart phone, a tablet device or other consumer electronic device, a network server, a network storage device, a switch router or other network communication device, or any other suitable device and may vary in size, shape, performance, functionality, and price. Further, an information handling system can include processing resources for executing machine-executable code, such as a central processing unit (CPU), a programmable logic array (PLA), an embedded device such as a System-on-a-Chip (SoC), or other control logic hardware. An information handling system can also include one or more computer-readable medium for storing machine-executable code, such as software or data. Additional components of an information handling system can include one or more storage devices that can store machine-executable code, one or more communications ports for communicating with external devices, and various input and output (I/O) devices, such as a keyboard, a mouse, and a video display. An information handling system can also include one or more buses operable to transmit information between the various hardware components.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents.

When referred to as a "device," a "module," or the like, the embodiments described herein can be configured as hardware. For example, a portion of an information handling system device may be hardware such as, for example, an integrated circuit (such as an Application Specific Integrated Circuit (ASIC), a Field Programmable Gate Array (FPGA), a structured ASIC, or a device embedded on a larger chip), a card (such as a Peripheral Component Interface (PCI) card, a PCI-express card, a Personal Computer Memory Card International Association (PCMCIA) card, or other such expansion card), or a system (such as a motherboard, a system-on-a-chip (SoC), or a stand-alone device).

The device or module can include software, including firmware embedded at a device, such as a Pentium class or PowerPC™ brand processor, or other such device, or software capable of operating a relevant environment of the information handling system. The device or module can also include a combination of the foregoing examples of hardware or software. Note that an information handling system can include an integrated circuit or a board-level product having portions thereof that can also be any combination of hardware and software.

Devices, modules, resources, or programs that are in communication with one another need not be in continuous communication with each other, unless expressly specified otherwise. In addition, devices, modules, resources, or programs that are in communication with one another can communicate directly or indirectly through one or more intermediaries.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. An information handling system, comprising:

a host processing complex including a memory; and a baseboard management controller (BMC) including a processor and a video capture and difference engine (VCDE), the processor configured to:

receive a memory compare command including a first pointer to a first block of the memory, a second pointer to a second block of the memory, and a memory block size;

determine whether the memory block size is greater than a threshold;

forward the memory compare command to the VCDE when the memory block size is greater than the threshold; and forward the memory compare command to the host processing complex when the memory block size is not greater than the threshold;

wherein the VCDE is configured to compare contents of the first block to contents of the second block in response to receiving the memory compare command; and wherein the host processing complex is configured to compare the contents of the first block to the contents of the second block in response to receiving the memory compare command.

2. The information handling system of claim 1, wherein:

the BMC further includes a video frame buffer; and the VCDE is configured to:

receive a frame buffer compare command; and compare contents of the video frame buffer with contents of a frame buffer block of the memory in response to receiving the frame buffer compare command.

3. The information handling system of claim 2, wherein the VCDE is configured to perform compare commands in a memory-to-memory mode and in a frame-buffer-to-memory mode.

4. The information handling system of claim 3, wherein in comparing the contents of the first block to the contents of the second block, the VCDE is configured to operate in the memory-to-memory mode.

5. The information handling system of claim 3, wherein in comparing the contents of the video frame buffer to the contents of the frame buffer block, the VCDE is configured to operate in the frame-buffer-to-memory mode.

6. The information handling system of claim 1, wherein the VCDE is further configured to provide a first indication when the contents of the first block differs from the contents of the second block.

7. The information handling system of claim 1, wherein the processor is further configured to provide a second indication when the contents of the first block differs from the contents of the second block.

8. The information handling system of claim 1, wherein the first block of the memory includes first BIOS set-up information and the second block of the memory includes second BIOS set-up information.

9. A method for comparing memory blocks, the method comprising:

receiving, by a processor of a baseboard management controller (BMC) of an information handling system, a memory compare command to compare contents of a first block of a memory of the information handling system with contents of a second block of the memory, the memory compare command including a first pointer to the first block, a second pointer to the second block, and a memory block size;

determining, by the processor, whether the memory block size is greater than a threshold;

forwarding, by the processor, the memory compare command to a video capture and difference engine (VCDE) of the BMC when the memory block size is greater than the threshold;

comparing, by the VCDE, the contents of the first block to the contents of the second block in response to receiving the memory compare command;

forwarding the memory compare command to a host processing complex of the information handling system; and comparing, by the host processing complex, the contents of the first block to the contents of the second block when the memory block size is not greater than the threshold.

10. The method of claim 9, further comprising:

receiving, by the VCDE, a frame buffer compare command to compare contents of a video frame buffer of the BMC with contents of a frame buffer block of the memory; and comparing, by the VCDE, the contents of the video frame buffer with the contents of the frame buffer block in response to receiving the frame buffer compare command.

11. The method of claim 10, wherein the VCDE is configured to perform compare commands in a memory-to-memory mode and in a frame-buffer-to-memory mode.

12. The method of claim 11, wherein in comparing the contents of the first block to the contents of the second block, the method further comprises:

operating, by the VCDE, in the memory-to-memory mode.

13. The method of claim 11, wherein in comparing the contents of the video frame buffer to the contents of the frame buffer block, the method further comprises:

operating, by the VCDE, in the frame-buffer-to-memory mode.

14. The method of claim 9, further comprising:

providing, by the VCDE, a first indication when the contents of the first block differs from the contents of the second block.

15. The method of claim 9, further comprising:

providing, by the processor, a second indication when the contents of the first block differs from the contents of the second block.

16. The method of claim 9, wherein the first block of the memory includes first BIOS set-up information and the second block of the memory includes second BIOS set-up information.

17. A baseboard management controller (BMC) of an information handling system, the BMC comprising:

a video capture and difference engine (VCDE);

a video frame buffer; and a processor configured to:

receive a memory compare command including a first pointer to a first block of a memory of the information handling system, a second pointer to a second block of the memory, and a memory block size;

determine whether the memory block size is greater than a threshold;

forward the memory compare command to the VCDE when the memory block size is greater than the threshold; and forward the memory compare command to a host processing complex of the information handling system when the memory block size is not greater than the threshold;

wherein the VCDE is configured to:

compare contents of the first block to contents of the second block in response to receiving the memory compare command;

receive a frame buffer compare command; and compare contents of the video frame buffer with contents of a frame buffer block of the memory in response to receiving the frame buffer compare command.

18. The BMC of claim 17, wherein the VCDE is further configured to provide a first indication when the contents of the first block differs from the contents of the second block.

19. The BMC of claim 17, wherein the processor is further configured to provide a second indication when the contents of the first block differs from the contents of the second block.

20. The BMC of claim 17, wherein the first block of the memory includes first BIOS set-up information and the second block of the memory includes second BIOS set-up information.

* * * * *